United States Patent [19]

Bream

[11] 4,380,562

[45] Apr. 19, 1983

[54] KINETIC WAVEFORM DEVICE

[76] Inventor: William A. Bream, 600 W. Aycock St., Raleigh, N.C. 27608

[21] Appl. No.: 235,681

[22] Filed: Feb. 18, 1981

[51] Int. Cl.[3] ..... A47G 33/04

[52] U.S. Cl. ..... 428/8; 272/8 D; 428/53; 428/101

[58] Field of Search ..... 46/53, 57; 156/63, 65; 428/3, 8, 53, 101, 7; 272/8 D

[56] References Cited

U.S. PATENT DOCUMENTS

| | | | |
|---|---|---|---|
| 2,534,673 | 12/1950 | Holland | 160/236 |
| 3,472,305 | 10/1969 | Lefes | 160/236 |
| 3,503,832 | 3/1970 | Umminger, Jr. | 156/63 X |
| 4,286,780 | 9/1981 | Vermeire | 428/8 X |

*Primary Examiner*—George F. Lesmes

*Assistant Examiner*—Beverly K. Johnson

[57] ABSTRACT

The present invention relates to a kinetic waveform that is adapted to be vertically oriented and anchored. As so oriented, the kinetic waveform device comprises a plurality of generally uniformly sized and shaped slats suspended and secured along two vertical axis threads that are in turn anchored between two vertically spaced apart points. Once vertically oriented and anchored, the waveform will generally revolve about a vertical axis with the individual slats slowly and generally progressively revolving about the same general vertical axis. Thus the plane of the slats tends to twist, ripple, and to continue to change shapes in a wave-like manner about the vertical axis thereby imparting an art like character to the waveform that is particularly beneficial in providing visual stimulation and intellectual entertainment.

9 Claims, 3 Drawing Figures

KINETIC WAVEFORM DEVICE

FIELD OF INVENTION

The present invention relates to waveform devices, and more particularly waveform devices which are adapted to be suspended and secured between two spaced apart vertical points.

SUMMARY AND OBJECTS OF INVENTION

The present invention entails a waveform device or apparatus that is designed to be oriented and anchored between two vertically spaced apart points. As so erected and anchored, the waveform device of the present invention comprises a plurality of vertically spaced elongated slats suspended and secured along two axis threads that extends through each of said slats. In the vertically oriented anchored position, the respective slats will revolve around a vertical reference axis in a wave-like manner. In particularly, the slats will form a twisting like plane around the vertical reference axis as the respective slats tend to revolve sequentially in a slow and gentle fashion around the reference vertical axis. The kinetic waveform device of the present invention will thusly provide visual stimulation and intellectual entertainment.

Viewed structurally, the waveform device of the present invention comprises a series of elongated slats, that are generally uniform in material, size and shape. The respective slats are secured along two axis threads in equal vertical spaced apart relationship. The two axis threads about the extreme ends of the waveform device are united together to form an apex which in turn is anchored to a respective securing point.

As erected, the slats will wind in an ever so gentle manner around what is referred to as a reference vertical axis. The symmetrical balance of mass and inertia within the waveform system enables it to move and perform in a smooth, flowing, efficient manner.

It is, therefore, an object of the present invention to provide a waveform device to provide visual stimulation and intellectual entertainment.

Another object of the present invention resides in the provision of a kinetic waveform device designed to be anchored between two vertical spaced apart points wherein the waveform device comprises a plurality of vertically and equally spaced slats secured and suspended along at least two axis threads wherein the slats slowly and smoothly revolve around a reference vertical axis.

It is also an object of the present invention to provide a waveform device of the character referred to above that assumes an art like character and is pleasing and attractive to view.

A further object of the present invention resides in the provision of a kinetic waveform device that is designed to rely on symmetrical balance of mass and inertia to give it a smooth and flowing efficient movement.

Another object of the present invention resides in the provision of a slat-like kinetic waveform device that is adapted to be suspended and anchored between two vertically spaced apart points such that the respective slats form a twisting like slat plane as the respective slats tend to move in sequential wave-like orderly fashion around a reference vertical axis.

Other objects and advantages of the present invention will become apparent from a study of the following description and the accompanying drawings which are merely illustrative of the present invention.

KINETIC WAVEFORM DEVICE

Figure 1:
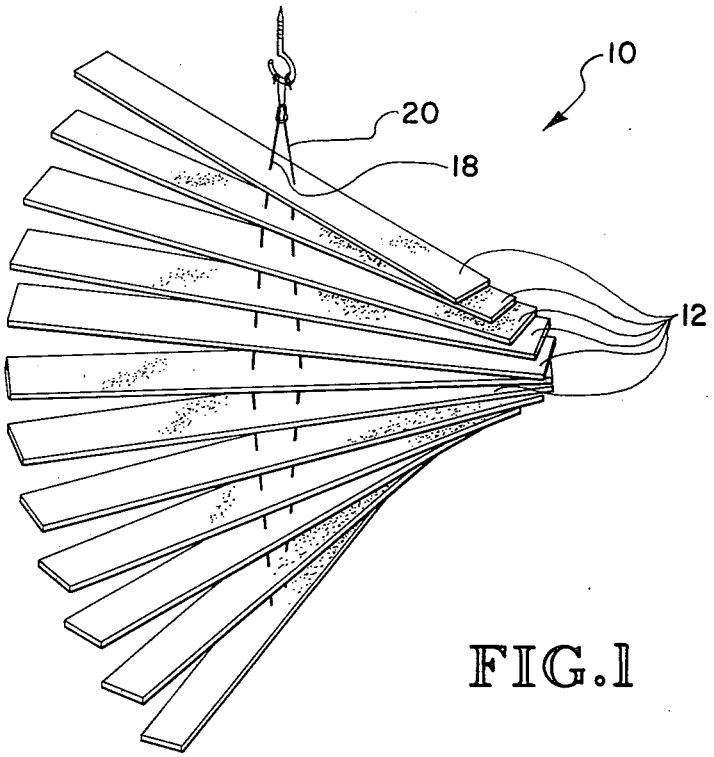
FIG. 1 is a fragmentary perspective view of a vertical portion of the waveform device of the present invention with the individual slats assuming a spiral like configuration.

With further reference to the drawings, the kinetic waveform device of the present invention is shown therein and indicated generally by the numeral 10. Kinetic waveform 10 is designed to be vertically oriented and secured between two vertically spaced apart points. The significance of this will become more apparent after reading and studying subsequent portions of this disclosure.

With particular reference to the waveform device 10, it is seen that the same comprises a series of vertically spaced apart slats 12. In the case of the preferred embodiment disclosed herein, the slats 12 are generally elongated and are uniform in length, thickness and width. Slats 12 are preferably made of a lightweight material such as woods, plastic, or the like. It is specially contemplated that wood would be an appropriate choice of material for the slats 12. In this regard, some of the more appropriate types of wood would include red wood, white pine, juniper, or mahogany.

Continuing to refer to respective slats 12, it is seen that each slat includes a pair of transversely spaced openings 14 formed vertically therethrough. Openings 14 are preferably formed equal distance from the transverse mid-point 16 of each slat.

Extending through openings 14 are a pair of axis threads 18 and 20. In a preferred embodiment of the present invention, it is contemplated that the axis threads would be formed of a string or thread-like material such as Dacron sailcloth thread.

The kinetic waveform device 10 of the present invention is essentially formed by securing the respective slats in vertical spaced apart relationship along said axis threads 18 and 20. To accomplish this, a clear fast drying acetone base glue such as Duco Cement is used. The glue or cement is interposed between the respective slats and the axis threads 18 and 20 within the openings 14 formed therein.

The respective axis threads 18 and 20 are united about upper and lower extremes of the kinetic waveform device 10. In this regard, it is seen that the axis threads 18 and 20 are effectively brought together to form upper apex 22 and lower apex 24. Attaching means is then secured to the upper and lower apexs 22 and 24 for anchoring and securing the kinetic waveform device 10 between two vertically spaced apart points, such as at the ceiling and floor levels of a room.

Figure 2:
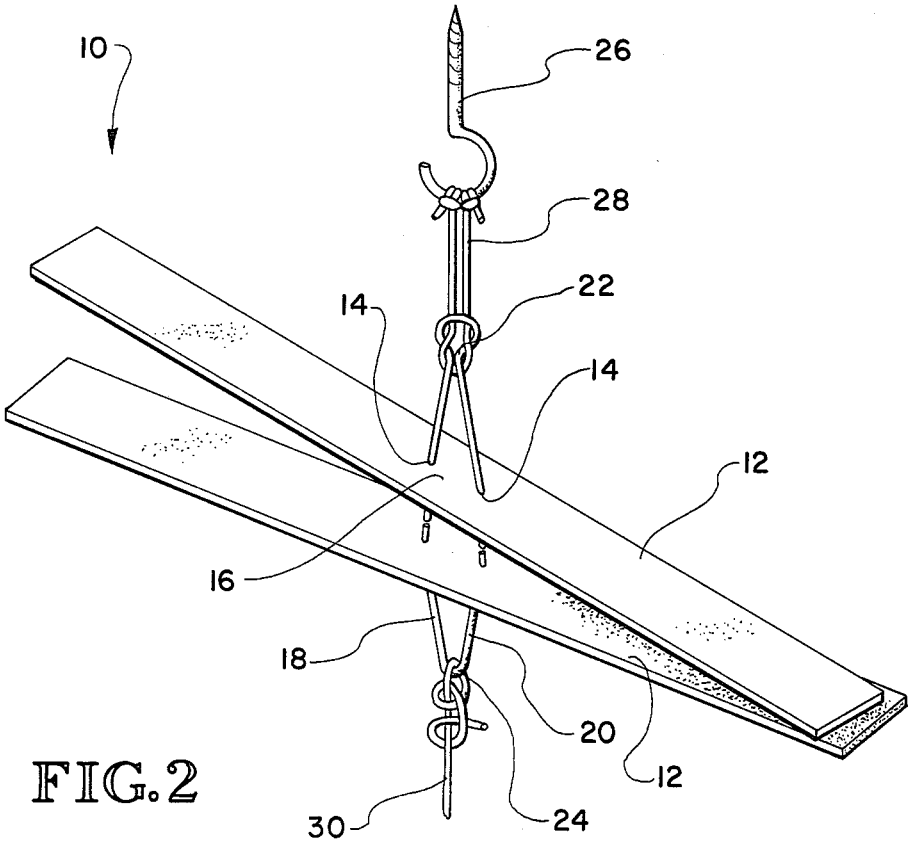
FIG. 2 is a fragmentary perspective view of upper and lower extremities of the waveform device of the present invention illustrating the joining of the axis threads about the end portions of the waveform.
Figure 3:
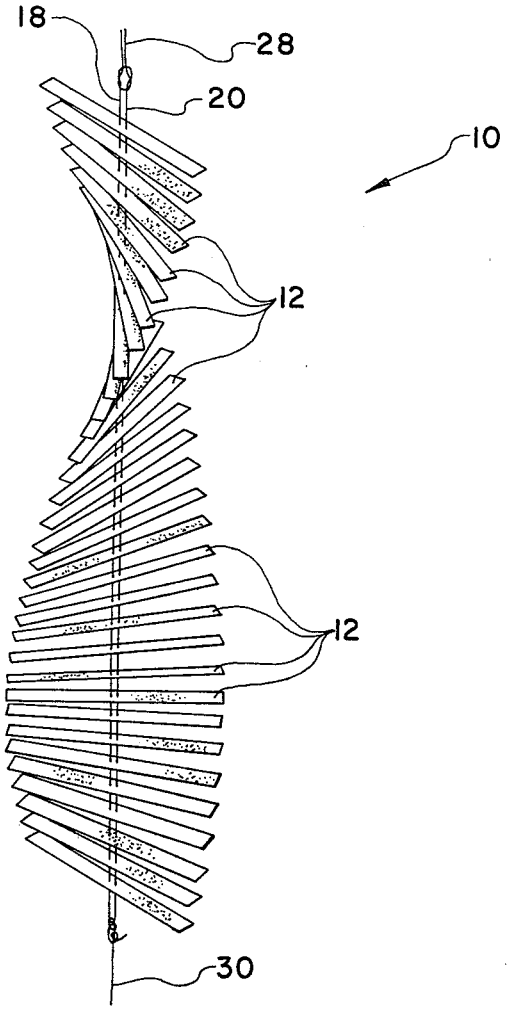
FIG. 3 is an illustration of the waveform device of the present invention showing its general appearance when vertically suspended.

In this regard, the attaching means for attaching the upper portion of the kinetic waveform device 10 includes a tie holder, string or thread 28 as seen in FIG. 2, which effectively connects to the upper apex 22 and extends upwardly to where the same is tied about a hook 26 anchored within a room ceiling.

About the bottom portion of the kinetic waveform device 10, a bottom anchoring line 30 is tied or otherwise secured to the lower apex area 24 and extends therefrom where the same can be appropriately tied or secured to a lower anchor point, such as at the floor.

With regard to the design specification for the kinetic waveform device 10 of the present invention, it is contemplated that the closer the slats 12 are spaced together, the closer the axis threads 18 and 20 should be spaced. It is contemplated that the ratio of the distance between the respective slats to the distance between the axis threads 18 and 20 should be within a range of 5:1 to 1:1.

It has been found that the relationship between the length of the respective slats 12, the separation distance between axis threads, and the vertical distance between slats controls the speed at which the wave motion travels through the waveform. The longer the slats, the slower the slat speed and vice versa. But it should be pointed out that the longer the slat 12, the greater the momentum assumed by the slat.

It is thusly appreciated that the kinetic waveform device 10 of the present invention can be designed in such a way that the frequencies can vary and that each waveform device may assume its own characteristics and "feel", depending on the size of the slats 12 and the particular relationship of the same with the axis threads 18 and 20 and other parts of the waveform device.

Appearing below is a chart of ratios that are contemplated to be appropriate for various size slats, slat spacings, and thread axis separation. The chart appears in units of length. As a practical matter, it is contemplated that one unit would typically equal one-sixteenth of an inch.

| WIDTH OF SLAT IN UNITS | LENGTH OF SLAT IN UNITS | THICKNESS OF SLAT IN UNITS | SLAT SEPARATION | AXIS SEPARATION |
|---|---|---|---|---|
| 12 | 96 | 1.5 | 12 | 3 |
| 10 | 224 | 2 | 12 | 3 |
| 20 | 352 | 2 | 12 | 4 |
| 8 | 192 | 2 | 12 | 3 |

As noted above, it is contemplated that for a more precision and smoothness, it is contemplated that the respective slats would be flat and rectangular. It should be pointed out, however, that the slats 12 could be of any reasonable configuration. The kinetic waveform device of the present invention would function even if the slats are not identical. However, uniformity in the slats provides for a smooth transition of energy with a minimum change in force. It could be expected that nonuniform slats or other irregularities will result in erratic and unpredictable waveform movement.

From the foregoing specification, it is appreciated that the present invention presents a kinetic waveform device that is especially designed for visual stimulation and intellectual enjoyment since the same assumes a character not unlike a piece of art or sculpture. Of particular importance is the very efficient and smooth waveform design and movement realized by the provision of the slats and axis threads and anchor points of the character, specification, and design outlined above.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A kinetic waveform device adapted to be vertically oriented and capable of providing various and continually varying waveform shapes and as vertically oriented, comprising: a plurality of vertically spaced and generally elongated slats extending through a substantial vertical distance with said slats being generally uniformly vertically shaped; at least two transversely spaced, vertical openings formed through each slat intermediately between opposite ends and wherein said vertical openings are equidistance from the midpoint of each slat; a pair of axis threads extending vertically through said transversely spaced vertical openings within said slats forming said waveform device; attaching means for securing said slats to said axis threads such that said slats are suspended along said axis threads in generally uniform vertically spaced apart relationship and are free to twist about said axis threads such that the shape of said waveform device can vary throughout its vertical distance and continue to vary throughout its vertical distance in order that the kinetic waveform device may continuously produce different waveform shapes; anchoring means secured to at least one end of said axis threads for vertically anchoring said waveform device; and wherein said openings in said respective slats are formed such that at least one opening lies on each side of the midpoint of each slat and wherein said openings are spaced relatively close together relative to the length of the respective slats such that the slats may tend to generally revolve about an axis that would extend between said pair of threads.

2. The waveform device of claim 1 wherein about at least one end of said waveform device said pair of axis threads are united to form an apex, and wherein said anchoring means is attached to said apex.

3. The waveform device of claim 2 wherein said anchoring means includes upper and lower attaching means for suspending said wave form device between two vertically spaced anchor points.

4. The waveform device of claim 1 wherein said attaching means for attaching said slats to said axis threads includes a glue substance interposed between said slats and said axis threads.

5. The waveform device of claim 1 wherein the ratio of the distance between successive slats to the distance between said axis threads falls within a range of 5:1 to 1:1.

6. The waveform device of claim 5 wherein said axis threads include Dacron threads.

7. The waveform device of claim 6 wherein each slat comprises a flat rectangular wood member.

8. The waveform device of claim 5 wherein the ratio of the length of each slat to the width of each slat falls within a range of 25:1 to 5:1.

9. The waveform device of claim 1 wherein each slat comprising the waveform device is of a generally uniform width, length and thickness.

* * * * *